US008470253B2

(12) United States Patent
Blaisdell et al.

(10) Patent No.: US 8,470,253 B2
(45) Date of Patent: Jun. 25, 2013

(54) EXHAUST FLOW DISTRIBUTION DEVICE

(75) Inventors: Jared D. Blaisdell, Bloomington, MN (US); Josh J. Kundert, Burnsville, MN (US); Bruce Hoppenstedt, Lakeville, MN (US)

(73) Assignee: Donaldson Company, Inc., Minneapolis, MN (US)

( * ) Notice: Subject to any disclaimer, the term of this patent is extended or adjusted under 35 U.S.C. 154(b) by 0 days.

(21) Appl. No.: 13/367,880

(22) Filed: Feb. 7, 2012

(65) Prior Publication Data

US 2012/0315195 A1 Dec. 13, 2012

Related U.S. Application Data

(63) Continuation of application No. 11/732,136, filed on Apr. 2, 2007, now Pat. No. 8,110,151.

(60) Provisional application No. 60/789,299, filed on Apr. 3, 2006.

(51) Int. Cl.
*B01D 50/00* (2006.01)

(52) U.S. Cl.
USPC ..... 422/176; 422/177

(58) Field of Classification Search
USPC ..... 422/176, 177, 180
See application file for complete search history.

(56) References Cited

U.S. PATENT DOCUMENTS

| | | | |
|---|---|---|---|
| 677,357 | A | 7/1901 | Hyde |
| 2,363,236 | A | 11/1944 | Fluor |
| 2,721,619 | A | 10/1955 | Cheairs |
| 2,732,913 | A | 1/1956 | Higgins |
| 3,180,712 | A | 4/1965 | Hamblin |
| 3,322,508 | A | 5/1967 | Ungerleider |
| 3,380,810 | A | 4/1968 | Hamblin |
| 3,445,196 | A | 5/1969 | Thomas |
| 3,606,611 | A | 9/1971 | Wright |
| 3,645,093 | A | 2/1972 | Thomas |
| 3,672,464 | A | 6/1972 | Rowley et al. |
| 3,719,457 | A | 3/1973 | Nagamatsu |
| 3,754,398 | A | 8/1973 | Mattavi |
| 3,780,772 | A | 12/1973 | Carnanhan et al. |

(Continued)

FOREIGN PATENT DOCUMENTS

| | | |
|---|---|---|
| CA | 721202 | 11/1965 |
| CA | 796934 | 10/1968 |

(Continued)

OTHER PUBLICATIONS

U.S. Appl. No. 11/223,460, filed Sep. 8, 2005.

*Primary Examiner* — Tom Duong

(74) *Attorney, Agent, or Firm* — Merchant & Gould P.C.

(57) ABSTRACT

The present disclosure relates to an diesel exhaust treatment device including a main body having a central longitudinal axis that extends between first and second ends of the main body. A catalyzed substrate is positioned within an interior of the main body. A side inlet is positioned at a side of the main body for directing exhaust gas into the interior of the main body. A flow distribution element is positioned within the interior of the main body at a location between the side inlet and an upstream face of the substrate. The flow distribution element extends across a direction of exhaust flow through the main body and is mounted at a side of the main body that is opposite the side inlet.

24 Claims, 2 Drawing Sheets

U.S. PATENT DOCUMENTS

| | | | |
|---|---|---|---|
| 3,852,042 | A | 12/1974 | Wagner |
| 3,910,770 | A | 10/1975 | Kobylinksi et al. |
| 3,964,875 | A | 6/1976 | Chang et al. |
| 3,972,687 | A | 8/1976 | Frietzsche |
| 4,002,433 | A | 1/1977 | Öser |
| 4,004,887 | A | 1/1977 | Stormont |
| 4,017,347 | A | 4/1977 | Cleveland |
| 4,032,310 | A | 6/1977 | Ignoffo |
| 4,050,903 | A | 9/1977 | Bailey et al. |
| 4,054,418 | A | 10/1977 | Miller et al. |
| 4,065,918 | A | 1/1978 | Rifkin |
| 4,086,063 | A | 4/1978 | Garcea |
| 4,124,091 | A | 11/1978 | Mizusawa |
| 4,183,896 | A | 1/1980 | Gordon |
| 4,209,493 | A | 6/1980 | Olson |
| 4,297,116 | A | 10/1981 | Cusick |
| 4,328,188 | A | 5/1982 | Kawata |
| 4,368,799 | A | 1/1983 | Wagner |
| 4,393,652 | A | 7/1983 | Munro |
| 4,416,674 | A | 11/1983 | McMahon et al. |
| 4,426,844 | A | 1/1984 | Nakano |
| 4,427,836 | A | 1/1984 | Kowalski et al. |
| 4,538,413 | A | 9/1985 | Shinzawa et al. |
| 4,541,240 | A | 9/1985 | Munro |
| 4,580,657 | A | 4/1986 | Schmeichel et al. |
| 4,601,168 | A | 7/1986 | Harris |
| 4,632,216 | A | 12/1986 | Wagner et al. |
| 4,634,459 | A | 1/1987 | Pischinger et al. |
| 4,652,286 | A | 3/1987 | Kusuda et al. |
| 4,730,454 | A | 3/1988 | Pischinger et al. |
| 4,732,743 | A | 3/1988 | Schmidt et al. |
| 4,797,263 | A | 1/1989 | Oza |
| 4,851,015 | A | 7/1989 | Wagner et al. |
| 4,854,123 | A | 8/1989 | Inoue |
| 4,866,932 | A | 9/1989 | Morita et al. |
| 4,867,768 | A | 9/1989 | Wagner et al. |
| 4,890,690 | A | 1/1990 | Fischer et al. |
| 4,902,309 | A | 2/1990 | Hempenstall |
| 4,969,537 | A | 11/1990 | Wagner et al. |
| 5,021,227 | A | 6/1991 | Kobayashi et al. |
| 5,043,147 | A | 8/1991 | Knight |
| 5,053,062 | A | 10/1991 | Barris et al. |
| 5,065,576 | A | 11/1991 | Kanazawa et al. |
| 5,082,478 | A | 1/1992 | Oono et al. |
| 5,110,560 | A | 5/1992 | Presz, Jr. et al. |
| 5,139,107 | A | 8/1992 | Nagai |
| 5,140,813 | A | 8/1992 | Whittenberger |
| 5,170,020 | A | 12/1992 | Kruger et al. |
| 5,171,341 | A | 12/1992 | Merry |
| 5,184,464 | A | 2/1993 | Harris |
| 5,185,998 | A | 2/1993 | Brew |
| 5,209,062 | A | 5/1993 | Vollenweider |
| 5,220,789 | A | 6/1993 | Riley et al. |
| 5,234,672 | A | 8/1993 | Ruscheweyh |
| 5,307,628 | A | 5/1994 | Castagne |
| 5,321,215 | A | 6/1994 | Kicinski |
| 5,322,537 | A | 6/1994 | Nakamura et al. |
| 5,339,630 | A | 8/1994 | Pettit |
| 5,355,973 | A | 10/1994 | Wagner et al. |
| 5,378,435 | A | 1/1995 | Gavoni |
| 5,408,828 | A | 4/1995 | Kreucher et al. |
| 5,426,269 | A | 6/1995 | Wagner et al. |
| 5,453,116 | A | 9/1995 | Fischer et al. |
| 5,457,945 | A | 10/1995 | Adiletta |
| 5,484,575 | A | 1/1996 | Steenackers |
| 5,584,178 | A | 12/1996 | Naegeli et al. |
| 5,611,832 | A | 3/1997 | Suzuki et al. |
| 5,643,536 | A | 7/1997 | Schmelz |
| 5,720,787 | A | 2/1998 | Kasai et al. |
| 5,732,555 | A | 3/1998 | Gracyalny et al. |
| 5,737,918 | A | 4/1998 | Khinsky et al. |
| 5,758,497 | A | 6/1998 | Frederiksen et al. |
| 5,771,689 | A | 6/1998 | Bareis et al. |
| 5,808,245 | A | 9/1998 | Wiese et al. |
| 5,828,013 | A | 10/1998 | Wagner et al. |
| 5,908,480 | A | 6/1999 | Ban et al. |
| 5,916,134 | A | 6/1999 | Yang et al. |
| 5,921,079 | A | 7/1999 | Harris |
| 5,992,141 | A | 11/1999 | Berriman et al. |
| 6,003,305 | A | 12/1999 | Martin et al. |
| 6,041,594 | A | 3/2000 | Brenner et al. |
| 6,050,088 | A | 4/2000 | Brenner |
| 6,082,487 | A | 7/2000 | Angelo et al. |
| 6,159,429 | A | 12/2000 | Bemel |
| 6,550,573 | B2 | 4/2003 | Wagner et al. |
| 6,712,869 | B2 | 3/2004 | Cheng et al. |
| 6,892,854 | B2 | 5/2005 | Wagner et al. |
| 8,110,151 | B2 * | 2/2012 | Blaisdell et al. ..... 422/176 |
| 2002/0073698 | A1 | 6/2002 | D'Herde et al. |
| 2002/0162319 | A1 | 11/2002 | Crocker et al. |
| 2003/0175175 | A1 | 9/2003 | Shishido et al. |

FOREIGN PATENT DOCUMENTS

| | | | |
|---|---|---|---|
| CA | 976771 | | 10/1975 |
| DE | 673 707 | | 3/1939 |
| DE | 2 314 465 | | 10/1974 |
| DE | 40 17 267 | A1 | 12/1990 |
| DE | 44 17 238 | A1 | 9/1994 |
| EP | 0 158 625 | A1 | 10/1985 |
| EP | 0 220 484 | A2 | 5/1987 |
| EP | 0 220 505 | A2 | 5/1987 |
| EP | 0 226 022 | A1 | 6/1987 |
| FR | 2 197 411 | | 3/1974 |
| FR | 2 718 188 | A1 | 10/1995 |
| GB | 2236690 | A | 4/1991 |
| GB | 2 383 548 | A | 7/2003 |
| JP | 54-137530 | | 10/1979 |
| JP | 57-158917 | | 9/1982 |
| JP | 60-169619 | | 9/1985 |
| JP | 62-160726 | | 7/1987 |
| JP | 63-140123 | | 6/1988 |
| JP | 3-10016 | | 1/1991 |
| JP | 3-21313 | | 1/1991 |
| JP | 5-288047 | | 11/1993 |
| SU | 1163889 | A | 6/1985 |
| WO | WO 89/01566 | | 2/1989 |
| WO | WO 93/24744 | | 12/1993 |
| WO | WO 95/06510 | | 3/1995 |

* cited by examiner

EXHAUST FLOW DISTRIBUTION DEVICE

CROSS-REFERENCE TO RELATED APPLICATIONS

This application is a continuation of U.S. patent application Ser. No. 11/732,136, filed Apr. 2, 2007, issued on Feb. 7, 2012, as U.S. Pat. No. 8,110,151, which claims the benefit of U.S. Patent Application Ser. No. 60/789,299, filed Apr. 3, 2006, which applications are hereby incorporated by reference in their entireties.

TECHNICAL FIELD

The present disclosure relates generally to an exhaust flow distribution device. More particularly, the disclosure relates to a device capable of altering the exhaust gas velocity profile upstream of an exhaust aftertreatment device.

BACKGROUND

Vehicle exhaust components for treating diesel engine exhaust often include a housing (e.g., a muffler body) containing an exhaust aftertreatment substrate (e.g., a catalytic converter substrate, a lean NOx catalyst substrate, an selective catalytic reduction (SCR) substrate, a NOx trap substrate or a diesel particulate filter substrate). The housing often includes either a side inlet or an axially in-line inlet. A side inlet is generally aligned perpendicular to a central axis of the housing, while an axially in-line inlet is generally co-axially aligned with a central axis of the housing.

The natural velocity profile of exhaust gas at the upstream face of an exhaust aftertreatment substrate positioned within a housing having an axial in-line inlet resembles a parabolic curve with the velocity maximum at the center of the flow distribution and decreasing significantly outwardly towards the periphery of the flow distribution. The natural velocity profile of exhaust gas at the upstream face of an exhaust aftertreatment substrate positioned within a side inlet housing has a maximum velocity at the half of the substrate located opposite from the inlet side of the housing. Non-uniform velocity flow distribution shortens the useful lives of the aftertreatment substrates, and reduces their operational efficiency.

Various flow distribution devices have been used to create a more uniform velocity flow profile. U.S. Pat. Nos. 5,355,973; 5,732,555; 5,185,998; and 4,797,263 disclose exemplary flow distribution devices that can be used to prolong the useful life and efficiency of exhaust aftertreatment devices. However, these flow distribution devices typically either impede fluid flow causing an undesirable increase in backpressure or do not adequately distribute flow across the face of their corresponding exhaust aftertreatment device. Consequently, there is a need for improved flow distribution devices that provide an effective flow distribution while at the same time generating reduced backpressure.

SUMMARY

One aspect of the present disclosure is to provide a flow distribution device that is constructed such that it effectively distributes flow without generating unacceptable levels of backpressure. In one embodiment, the flow distribution device is adapted to distribute flow effectively in a side inlet vehicle exhaust component.

DETAILED DESCRIPTION

Figure 1:
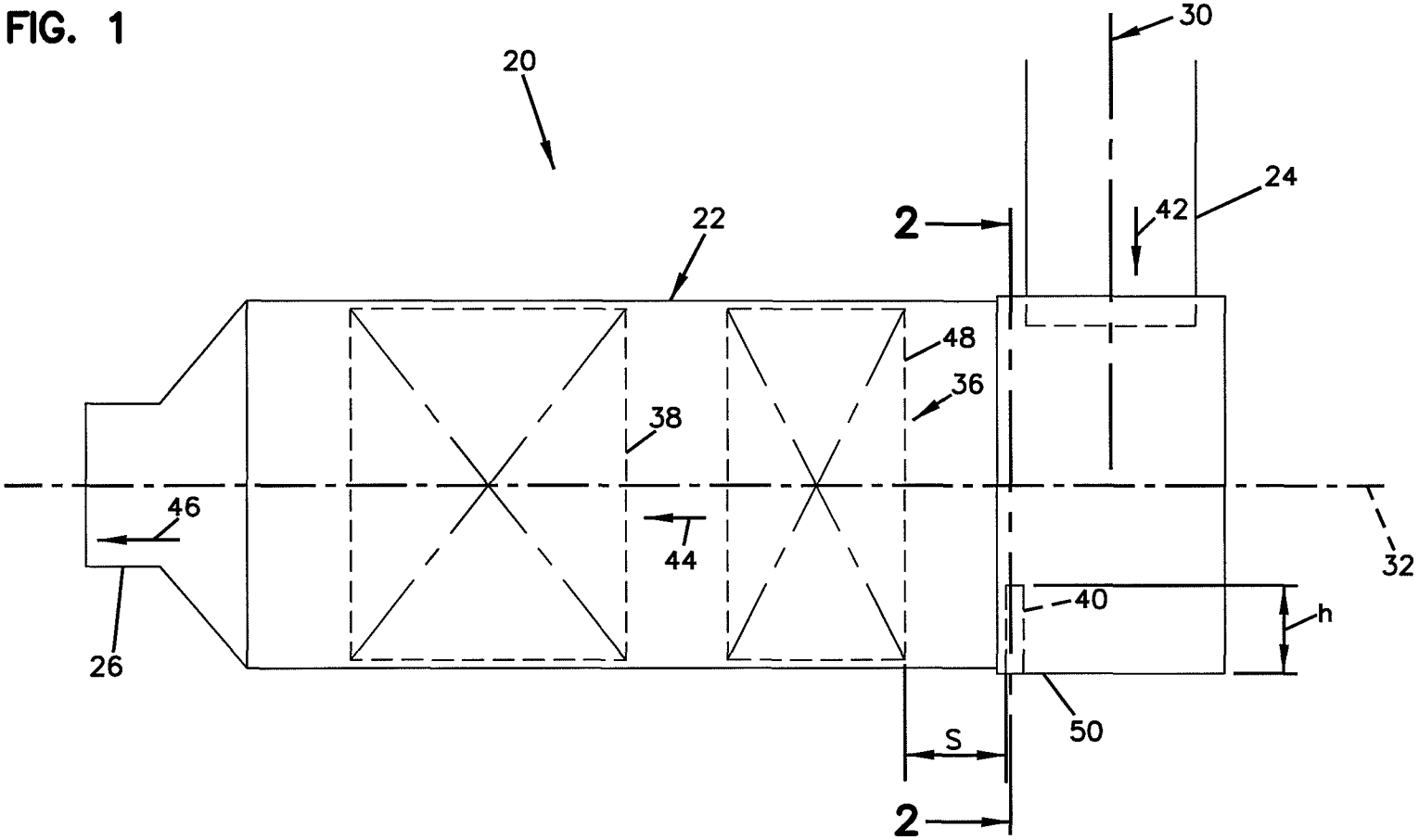
FIG. 1 is a schematic view of a vehicle exhaust system component assembly having a flow distributor that includes features that are examples of inventive aspects in accordance with the principles of the present disclosure.

FIG. 1 is a schematic illustration of a vehicle exhaust system component 20 (e.g., a muffler or other enclosure in which one or more exhaust aftertreatment devices are contained) having features that are examples of inventive aspects in accordance with the principles of the present disclosure. The component 20 includes a main body 22 (e.g., a shell, housing, conduit, tube, etc.) having a side inlet 24 and a co-axial outlet 26. The main body 22 can be constructed of one or more pieces. The side inlet 24 has an axis 30 that is generally perpendicular to a central axis 32 of the main body 22. The outlet 26 and the main body 22 are depicted sharing the same axis 32. Aftertreatment devices are shown mounted within the main body 22. For example, a catalytic converter 36 and a diesel particulate filter 38 are shown mounted within the main body 22. A flow distribution element 40 is shown positioned upstream from the catalytic converter 36. Flow arrows 42, 44, and 46 illustrate that the direction of exhaust gas flow is from the inlet 24 to the outlet 26. As used herein, the term "generally perpendicular" means perpendicular or close to perpendicular.

The flow distribution element 40 is preferably configured to improve exhaust flow uniformity across an upstream face 48 of the catalytic converter 36 without generating significant back pressure in the exhaust system 10. In alternative embodiment, the flow distribution device can be used to distribute flow provided to other types of aftertreatment devices such as diesel particulate filters, lean NOx catalyst devices, selective catalytic reduction (SCR) catalyst devices, lean NOx traps, or other devices for removing for removing pollutants from the exhaust stream.

Catalytic converters are commonly used to convert carbon monoxides and hydrocarbons in the exhaust stream into carbon dioxide and water. Diesel particulate filters are used to remove particulate matter (e.g., carbon based particulate matter such as soot) from an exhaust stream. Lean NOx catalysts are catalysts capable of converting NOx to nitrogen and oxygen in an oxygen rich environment with the assistance of low levels of hydrocarbons. For diesel engines, hydrocarbon emissions are too low to provide adequate NOx conversion, thus hydrocarbons are required to be injected into the exhaust stream upstream of the lean NOx catalysts. SCR's are also capable of converting NOx to nitrogen and oxygen. However, in contrast to using HC's for conversion, SCR's use reductants such as urea or ammonia that are injected into the exhaust stream upstream of the SCR's. NOx traps use a material such as barium oxide to absorb NOx during lean burn operating conditions. During fuel rich operations, the NOx is desorbed and converted to nitrogen and oxygen by catalysts (e.g., precious metals) within the traps.

Diesel particulate filters can have a variety of known configurations. An exemplary configuration includes a monolith ceramic substrate having a "honey-comb" configuration of plugged passages as described in U.S. Pat. No. 4,851,015 that is hereby incorporated by reference in its entirety. Wire mesh configurations can also be used. In certain embodiments, the substrate can include a catalyst. Exemplary catalysts include precious metals such as platinum, palladium and rhodium, and other types of components such as base metals or zeolites.

For certain embodiments, diesel particulate filters can have a particulate mass reduction efficiency greater than 75%. In other embodiments, diesel particulate filters can have a particulate mass reduction efficiency greater than 85%. In still other embodiments, diesel particulate filters can have a particulate mass reduction efficiency equal to or greater than 90%. For purposes of this specification, the particulate mass reduction efficiency is determined by subtracting the particulate mass that enters the filter from the particulate mass that exits the filter, and by dividing the difference by the particulate mass that enters the filter.

Catalytic converters can also have a variety of known configurations. Exemplary configurations include substrates defining channels that extend completely therethrough. Exemplary catalytic converter configurations having both corrugated metal and porous ceramic substrates/cores are described in U.S. Pat. No. 5,355,973, that is hereby incorporated by reference in its entirety. The substrates preferably include a catalyst that promotes an oxidation reaction at the catalytic converter. For example, the substrate can be made of a catalyst, impregnated with a catalyst or coated with a catalyst. Exemplary oxidation catalysts include precious metals such as platinum, palladium and rhodium, and other types of components such as base metals or zeolites.

In one non-limiting embodiment, a catalytic converter can have a cell density of at least 200 cells per square inch, or in the range of 200-400 cells per square inch. A preferred catalyst for a catalytic converter is platinum with a loading level greater than 30 grams/cubic foot of substrate. In other embodiments the precious metal loading level is in the range of 30-100 grams/cubic foot of substrate. In certain embodiments, the catalytic converter can be sized such that in use, the catalytic converter has a space velocity (volumetric flow rate through the catalytic converter/volume of the catalytic converter) less than 150,000/hour or in the range of 50,000-150,000/hour.

Figure 2:
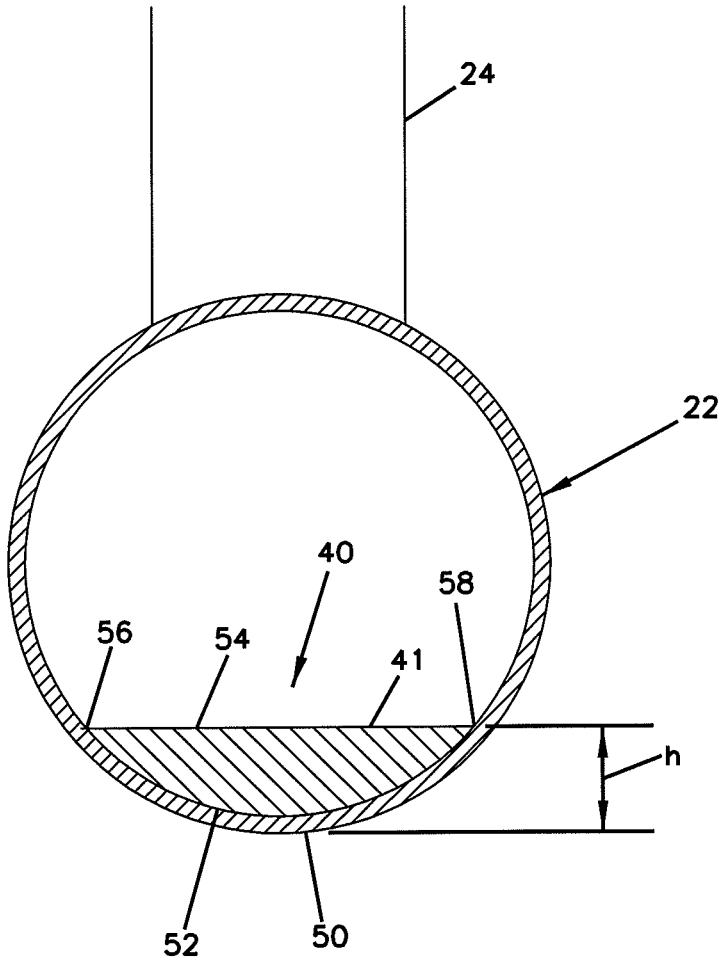
FIG. 2 is a cross-sectional view taken along section line 2-2.

Referring to FIGS. 1 and 2, the flow distribution element 40 of the component 20 is positioned adjacent a side 50 of the main body 22 that is opposite from the inlet 24. The flow distribution element 40 is depicted as a flat plate 41 having a curved edge 52 that matches the inner diameter of the main body 22. The plate 41 also includes a straight edge 54 that extends from one end 56 of the curved edge 52 to an opposite end 58 of the curved edge 52. The curved edge 52 seats against the inner diameter of the main body 22 and the plate 41 extends upwardly from the side 50 of the main body 22. The plate 41 is shown aligned along a plane that is generally perpendicular to the central axis 32 of the main body 22.

In use, the exhaust gases are directed into the main body 22 through the inlet 24. Upon entering the main body 22, the exhaust flow encounters the flow distribution device 40. The flow distribution element 40 forms a mixing wall/barrier positioned at the side 50 of the main body 22 upon which flow from the inlet 24 impinges. The exhaust gases then flow over/past the flow distribution device 40 to the catalytic converter 36. At the upstream face of the catalytic converter, flow is fairly evenly distributed by virtue of the flow distribution element 40. Upon exiting the catalytic converter, the exhaust flow travels through the diesel particulate filter and exits the main body 22 through the outlet 26.

The flow distribution element 40 can also be referred to as a flow distribution plate, a flow distributor, a flow distribution member, a flow distribution structure, or like terms. The main body 22 can also be referred to as a housing, an aftertreatment device housing, an enclosure, a conduit, or like terms.

In certain embodiments, the inlet 24 can include a cylindrical inlet pipe, and the main body 22 can also be cylindrical in shape. In one example embodiment, the inlet 24 can have a diameter in the range of 4-6 inches and the main body can have a diameter in the range of 9-12 inches.

The flow distribution element 40 is preferably configured to provide generally uniform flow distribution across the upstream face of the catalytic converter 36 without causing too much back pressure. In one example embodiment, the flow distribution element 40 is configured to provide a $\gamma$ value greater than or equal to 0.9 and a pressure loss measured across the distribution element that is less than 0.1 inches of mercury. In certain embodiments, the flow distribution element reduces the back pressure at the inlet of the component 20 as compared to the back pressure at the inlet of an identical component that is not equipped with the flow distribution element and that is exposed to the same exhaust flow conditions. $\gamma$ is a calculated value representative of flow speed uniformity across the upstream area/face of a substrate (e.g., a catalytic converter substrate, a DPF substrate, an SCR substrate, a NOx absorber substrate, a lean NOx catalyst substrate, etc.). When $\gamma$ is equal to 1, perfect flow uniformity exists across the entire upstream face/area of the substrate. $\gamma$ is calculated according to the following formula:

$$\gamma = 1 - \frac{\sum_{i=1}^{n} \sqrt{(V_i - V_A)^2} \times A}{2 \times A \times V_A}$$

In the above formula, A is the total area of the upstream face of the substrate. The total area A is formed by n discrete/localized areas. Vi is the exhaust flow velocity at each of the n discrete/localized areas, and $V_A$ is the average exhaust flow velocity across the total area A.

A variety of factors control the effectiveness of the distribution element 40 for providing substantially uniform flow. Example factors include the spacing S defined between the distribution element 40 and the upstream face of the catalytic converter 36 and the height h that the distribution element projects into the main body 22. The dimensions of the spacing S the height h are dependent of the flow distribution desired and the sizes and arrangement of the inlet 24 and the main body 22. In certain embodiments, the spacing S is less than 3 inches, or less than 2 inches, or less than 1 inch. In other embodiments, the height h is less than 50, 40 or 30 percent of the inner diameter of the main body 22 or the outer diameter of the catalytic converter 36. In other embodiments, the height h is in the range of 10-40 percent, or 10-30 percent, or 20-40 percent, or 20-30 percent of the inner diameter of the main body or the outer diameter of the catalytic converter. In certain embodiments, the height h is less than 5 inches, or less than 4 inches, or less than 3 inches, or in the range of 1-5 inches, or in the range of 1-4 inches, or in the range of 2-4 inches or in the range of 2-3 inches. In still other embodiments, the spacing S is less than 20 percent of the inner diameter of the main body, or less than 15 percent of the inner diameter of the main body, or less than 10 percent of the inner diameter of the main body, or less than 5 percent of the inner diameter of the main body. In a preferred embodiment having a main body 22 with an 11 inch inner diameter, a 10.5 inch diameter catalytic converter and a side inlet having a diameter of 5 inches, the spacing S is 0.84 inches and the height h is 2.88 inches.

From the forgoing detailed description, it will be evident that modifications and variations can be made in the devices of the disclosure without departing from the spirit or scope of the invention.

What is claimed is:

1. A diesel exhaust treatment device comprising:

a main body having a central longitudinal axis that extends between first and second ends of the main body, the main body defining a flow passage through which exhaust gases flow from the first end to the second end;

a catalyzed substrate positioned within the flow passage of the main body, the substrate having an upstream face;

a side inlet positioned at a first side portion of the main body for directing the exhaust gases into the flow passage of the main body; and a flow distribution element positioned within the flow passage of the main body at a location between the inlet and the upstream face of the substrate, the flow distribution element extending across a direction of exhaust flow through the main body, the flow distribution element being mounted at a second side portion of the main body that is diametrically opposite the first side portion of the main body such that the side inlet and the flow distribution element are positioned at diametrically opposite sides of the central longitudinal axis of the main body, at least a portion of the flow distribution element having a height that is less than 50 percent of a corresponding internal height of the flow passage of the main body between the inlet and the upstream face of the substrate, wherein the height of the flow distribution element and the internal height of the flow passage of the main body are measured along a plane that is generally perpendicular to the central longitudinal axis.

2. The diesel exhaust treatment device of claim 1, wherein the flow distribution element provides a flow distribution value y at the upstream face of the substrate that is greater than 9.

3. The diesel exhaust treatment device of claim 2, wherein the flow distribution element generates less than 0.1 inches of mercury of back pressure.

4. The diesel exhaust treatment device of claim 1, wherein the flow distribution element includes a plate aligned along the plane that is generally perpendicular to the central longitudinal axis of the main body.

5. The diesel exhaust treatment device of claim 4, wherein the plate is not perforated.

6. The exhaust treatment device of claim 5, wherein the main body has a cylindrical inner diameter, wherein the plate has a lower edge that is curved to match the inner diameter of the main body, and wherein the plate has a generally straight upper edge that extends across the direction of exhaust flow through the main body.

7. The exhaust treatment device of claim 1, wherein the substrate includes a catalytic converter.

8. The exhaust treatment device of claim 7, further comprising a diesel particulate filter mounted within an interior of the main body at a location downstream from the catalytic converter.

9. The exhaust treatment device of claim 1, wherein the side inlet defines a central axis that is generally perpendicular relative to the central longitudinal axis of the main body.

10. The exhaust treatment device of claim 1, wherein the flow distribution element is generally parallel to the upstream face of the substrate.

11. The exhaust treatment device of claim 1, wherein the main body defines a cylindrical inner diameter, and wherein the inner diameter equals the internal height of the main body.

12. The exhaust treatment device of claim 1, wherein the height of the flow distribution element is less than 40 percent of the internal height of the main body.

13. The exhaust treatment device of claim 1, wherein the height of the flow distribution element is less than 30 percent of the internal height of the main body.

14. The exhaust treatment device of claim 1, wherein the height of the flow distribution element is in the range of 10-40 percent of the internal height of the main body.

15. The exhaust treatment device of claim 1, wherein the height of the flow distribution element is in the range of 10-30 percent of the internal height of the main body.

16. The exhaust treatment device of claim 1, wherein the height of the flow distribution element is in the range of 1-5 inches.

17. The exhaust treatment device of claim 1, wherein the height of the flow distribution element is in the range of 2-4 inches.

18. The exhaust treatment device of claim 1, wherein a spacing between the flow distribution element and the upstream face of the substrate is less than 3 inches.

19. The exhaust treatment device of claim 1, wherein a spacing between the flow distribution element and the upstream face of the substrate is less than 2 inches.

20. The exhaust treatment device of claim 1, wherein a spacing between the flow distribution element and the upstream face of the substrate is less than 1 inch.

21. The exhaust treatment device of claim 1, wherein a spacing between the flow distribution element and the upstream face of the substrate is less than 20 percent of the internal height of the main body.

22. The exhaust treatment device of claim 1, wherein a spacing between the flow distribution element and the upstream face of the substrate is less than 10 percent of the internal height of the main body.

23. The exhaust treatment device of claim 1, wherein a spacing between the flow distribution element and the upstream face of the substrate is less than 5 percent of the internal height of the main body.

24. The exhaust treatment device of claim 1, wherein the portion of the flow distribution element is located at the center of the flow passage measured along the plane that is generally perpendicular to the central longitudinal axis.

* * * * *